US011002218B2

(12) United States Patent
Beyer

(10) Patent No.: US 11,002,218 B2
(45) Date of Patent: May 11, 2021

(54) NOTCHED SPARK PLUG

(71) Applicant: Ford Global Technologies, LLC, Dearborn, MI (US)

(72) Inventor: Timothy Beyer, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 159 days.

(21) Appl. No.: 16/111,124

(22) Filed: Aug. 23, 2018

(65) Prior Publication Data

US 2020/0063687 A1 Feb. 27, 2020

(51) Int. Cl.

*F02F 1/00* (2006.01)
*F02F 1/24* (2006.01)
*H01T 13/08* (2006.01)

(52) U.S. Cl.

CPC ..... *F02F 1/242* (2013.01); *H01T 13/08* (2013.01)

(58) Field of Classification Search

CPC ..... F02F 1/242; H01T 13/08
See application file for complete search history.

(56) References Cited

U.S. PATENT DOCUMENTS 4,989,557 A * 2/1991 Penney ..... H01T 13/08 123/169 EL
5,091,672 A * 2/1992 Below ..... H01T 13/32 123/169 R
6,049,161 A * 4/2000 Lykowski ..... B25B 13/02 313/118
6,938,524 B2 * 9/2005 Hsien ..... B25B 13/065 81/124.6
8,035,286 B2 * 10/2011 Below ..... H01T 13/08 313/143
8,716,923 B2 5/2014 Mahon
8,866,369 B2 10/2014 Gfell et al.
2009/0085304 A1 * 4/2009 Miyashita ..... H01T 13/08 277/591
2015/0035427 A1 * 2/2015 Farrell ..... H01T 13/32 313/141
2015/0343614 A1 * 12/2015 Hassler ..... B25B 13/483 81/124.7
2018/0323582 A1 * 11/2018 Chuong Vo ..... H01T 13/08
2019/0210197 A1 * 7/2019 Baldonado ..... B25G 1/102

FOREIGN PATENT DOCUMENTS

EP 2187490 A1 5/2010
FR 2794575 A1 12/2000
FR 2894724 A1 6/2007

* cited by examiner

*Primary Examiner* — Phutthiwat Wongwian
*Assistant Examiner* — Sherman D Manley
(74) *Attorney, Agent, or Firm* — Geoffrey Brumbaugh; McCoy Russell LLP

(57) ABSTRACT

Methods and systems are provided for a spark plug of an internal combustion engine. In one example, a spark plug includes a housing section having a first groove and an opposing, second groove. A tool including a first protrusion and second protrusion may couple with the first and second grooves of the spark plug in order to drive the spark plug to either of only two coupled positions with a cylinder head.

10 Claims, 7 Drawing Sheets

NOTCHED SPARK PLUG

FIELD

The present description relates generally to methods and systems for a spark plug of an internal combustion engine.

BACKGROUND/SUMMARY

Spark plugs may be coupled to a cylinder head of an internal combustion engine to ignite a compressed air and fuel charge within engine cylinders. Spark plugs often include a central electrode and a ground electrode configured to produce spark to ignite the air and fuel charge. The spark plugs often include threads adapted to engage with counterpart threads of the cylinder head, with the cylinder head capping the cylinders. The orientation of the electrodes within the cylinders may vary depending on an amount of engagement of the threads of the spark plugs with the threads of the cylinder head. It is often desirable to control a position of the electrodes in order to adjust air and fuel charge combustion parameters.

One example approach is shown by Lykowski in U.S. Pat. No. 6,049,161. Therein, a spark plug is disclosed having a splined section for installation of the spark plug. The splined section includes at least one spline having an outer surface and a corresponding castellation recessed from the outer surface.

However, the inventors herein have recognized potential issues with such systems. As one example, it may be difficult to determine a position of the spark plug within the cylinder head during conditions in which the spark plug is seated deeply within a passage of the cylinder head. As a result, the position of the electrodes of the spark plug after coupling the spark plug to the cylinder head may not correspond to a desired position to achieve a desired engine operating performance.

In one example, the issues described above may be addressed by a spark plug, comprising: a housing section having a plurality of planar surfaces arranged annularly around a central axis of the spark plug, including a first planar surface arranged opposite a second planar surface, and coupled to a threaded section of the spark plug; and only two grooves in the housing section, including a first groove in the first planar surface and a second groove in the second planar surface. In this way, the first groove and second groove may indicate a position of a ground electrode of the spark plug within a combustion chamber of an engine.

As one example, the second groove may be radially aligned with a base of the ground electrode of the spark plug, and the first groove may be positioned radially opposite to the second groove. The first and second groove may be shaped to engage with first and second protrusions of a tool configured to couple with the spark plug, and the tool may be driven to adjust the position of the spark plug within the combustion chamber to either of only two opposing positions. While the spark plug is in either of the two opposing positions, engine performance may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-10 are shown to scale, though other relative dimensions may be used, if desired.

DETAILED DESCRIPTION

Figure 2:
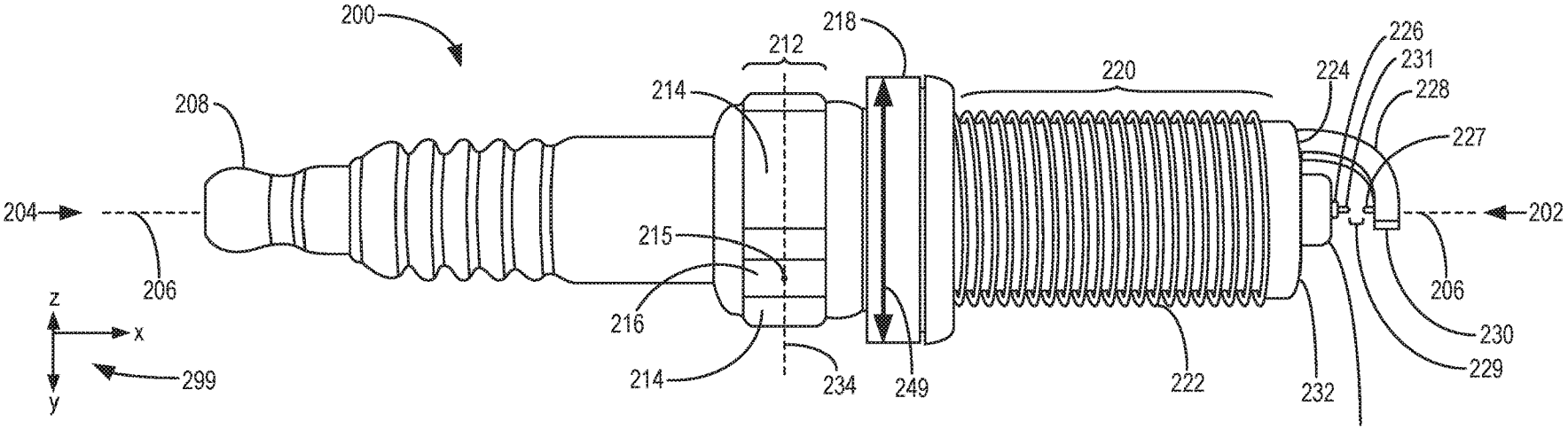
FIG. 2 shows a first side view of a spark plug of an engine.
Figure 3:
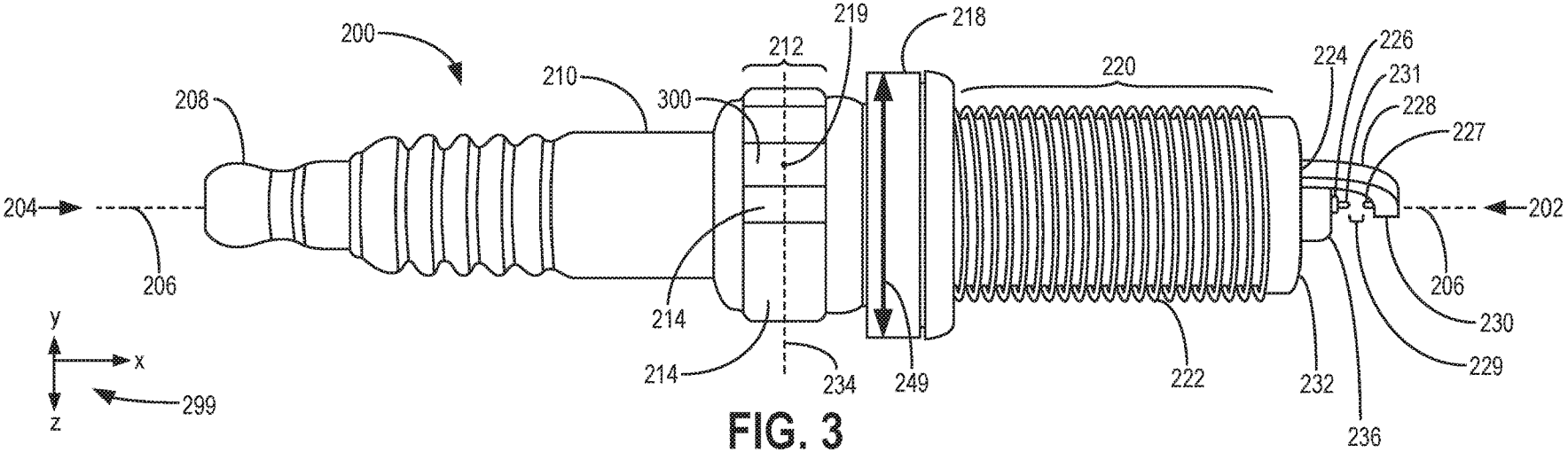
FIG. 3 shows a second side view of the spark plug of FIG. 2.
Figure 4:
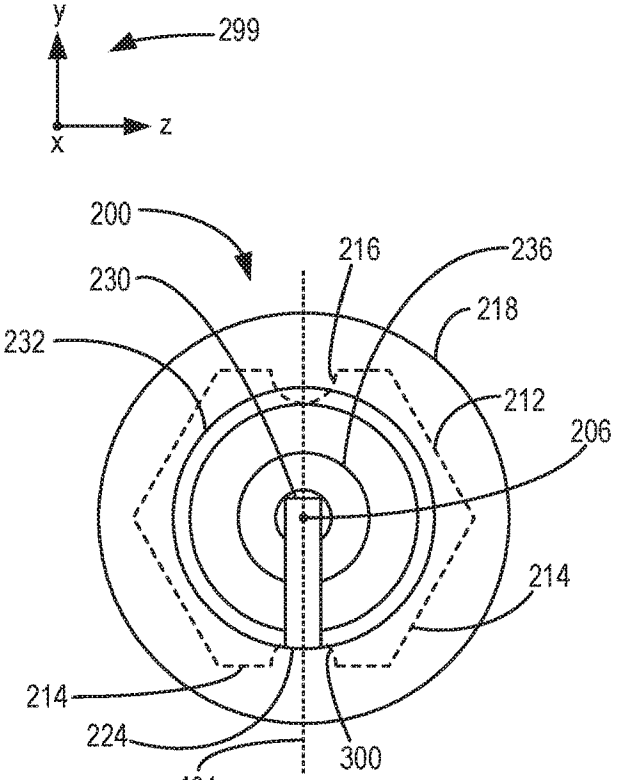
FIG. 4 shows an end view of the spark plug of FIGS. 2-3.
Figure 7:
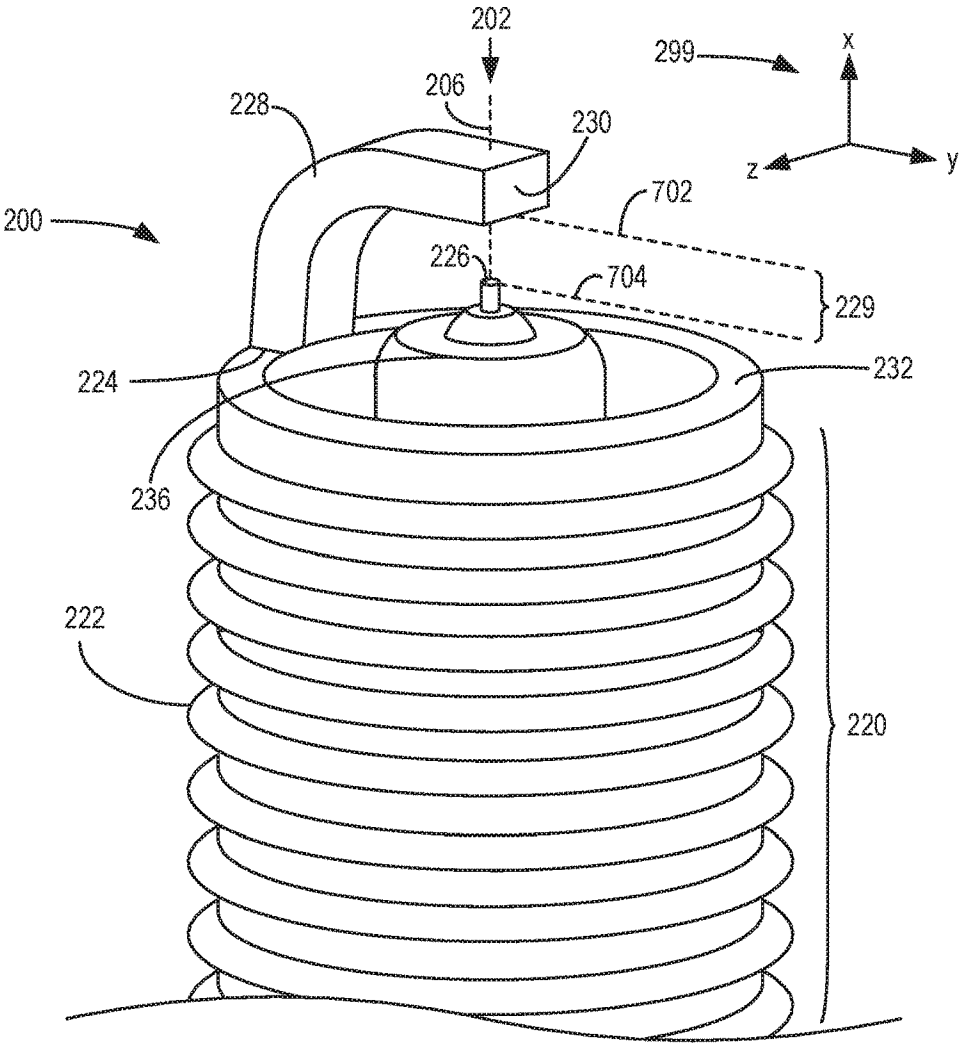
FIG. 7 shows an enlarged, partial perspective view of electrodes of the spark plug of FIGS. 2-4 and 6.
Figure 8:
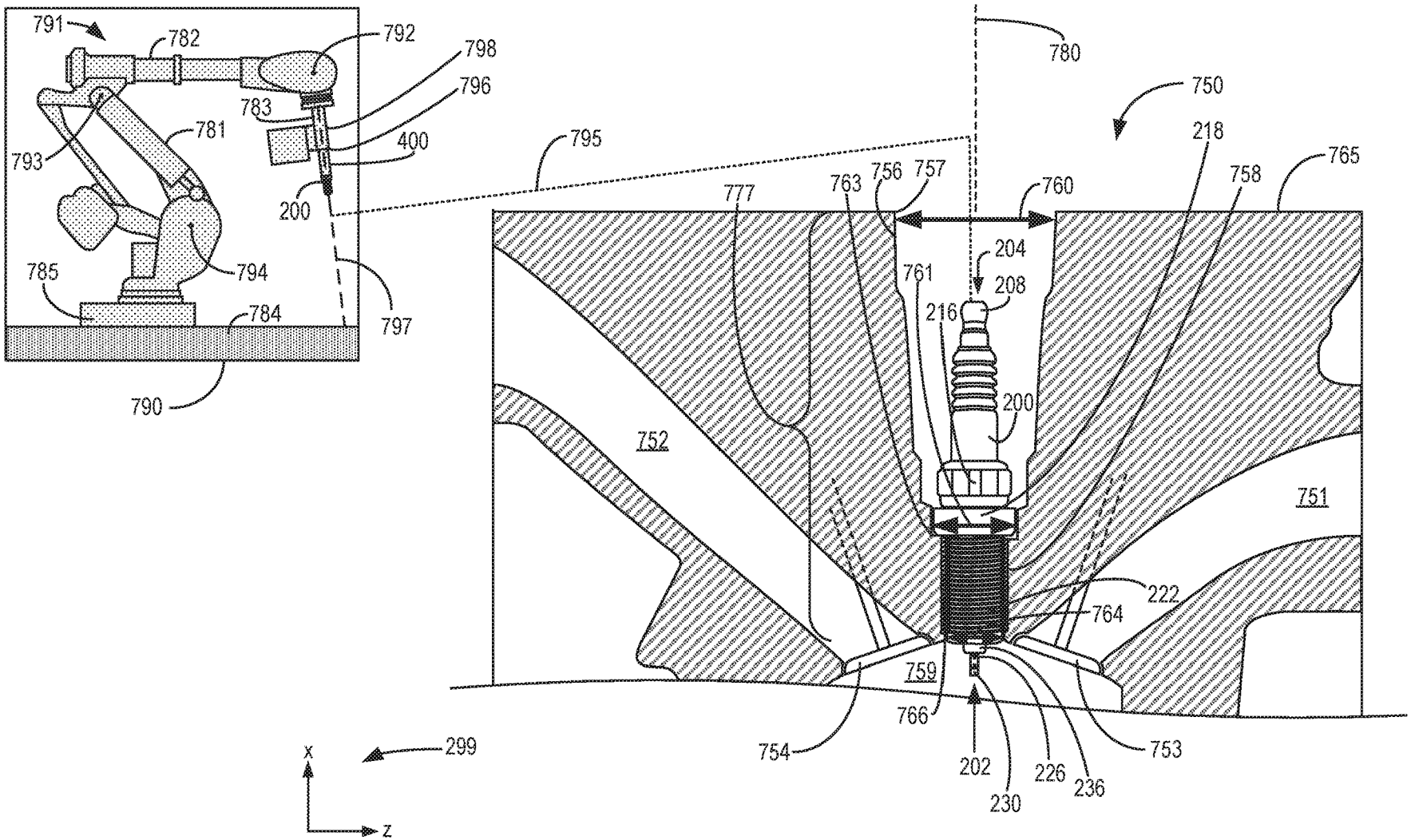
FIG. 8 shows a partial cross-sectional view of a cylinder head including the spark plug of FIGS. 2-4 and 6-7, and schematically shows an assembly robot adapted to couple the spark plug to the cylinder head.
Figure 10:
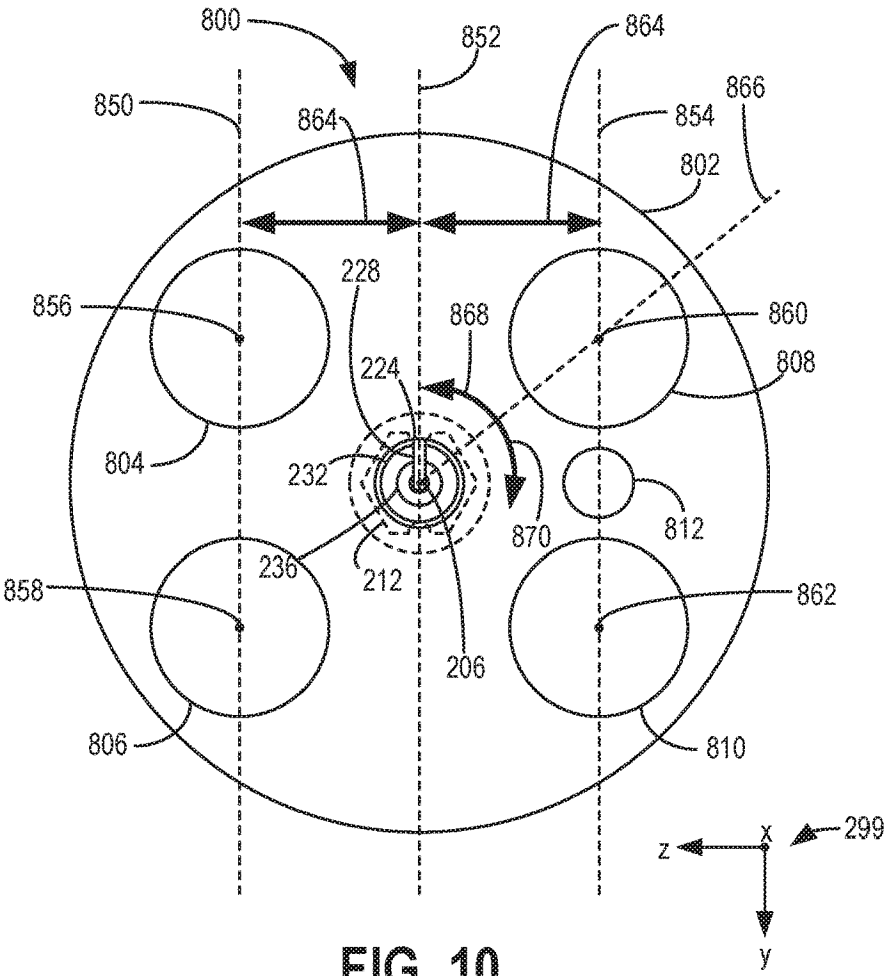
FIG. 10 shows a view of the top of the combustion chamber of FIG. 9, with the spark plug extending into the combustion chamber in a second orientation.
Figure 9:
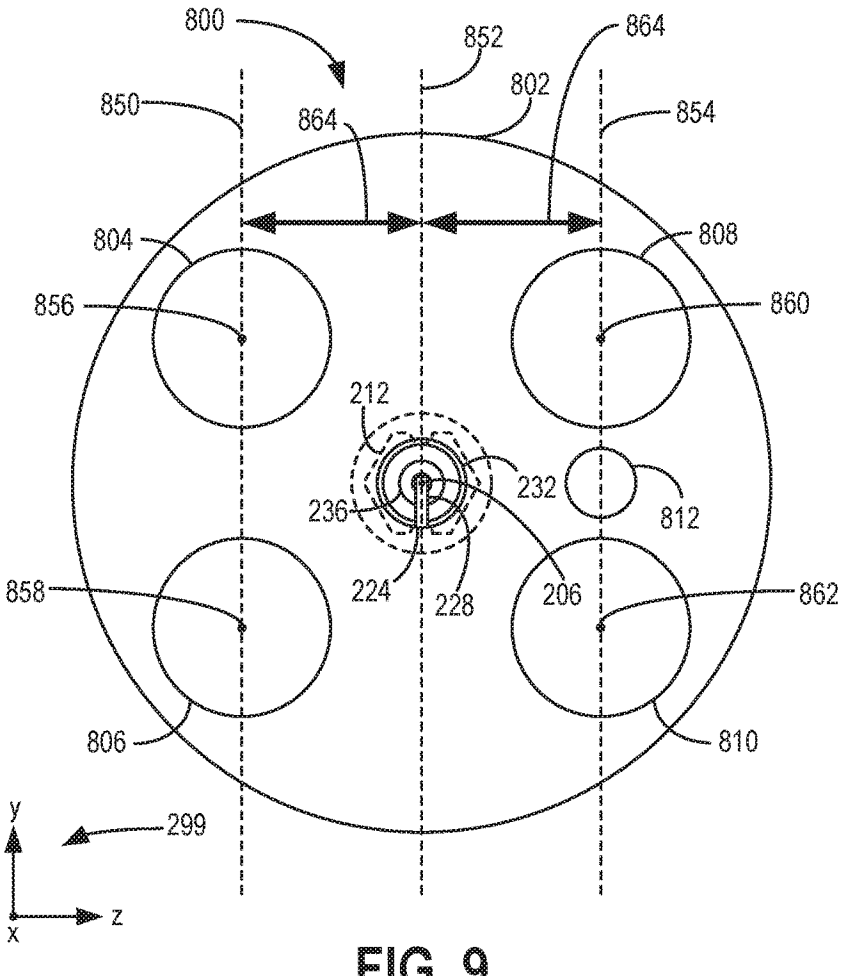
FIG. 9 shows a view of a top of a combustion chamber capped by a cylinder head, with the spark plug of FIGS. 2-4 and 6-8 extending into the combustion chamber in a first orientation.
Figure 11:
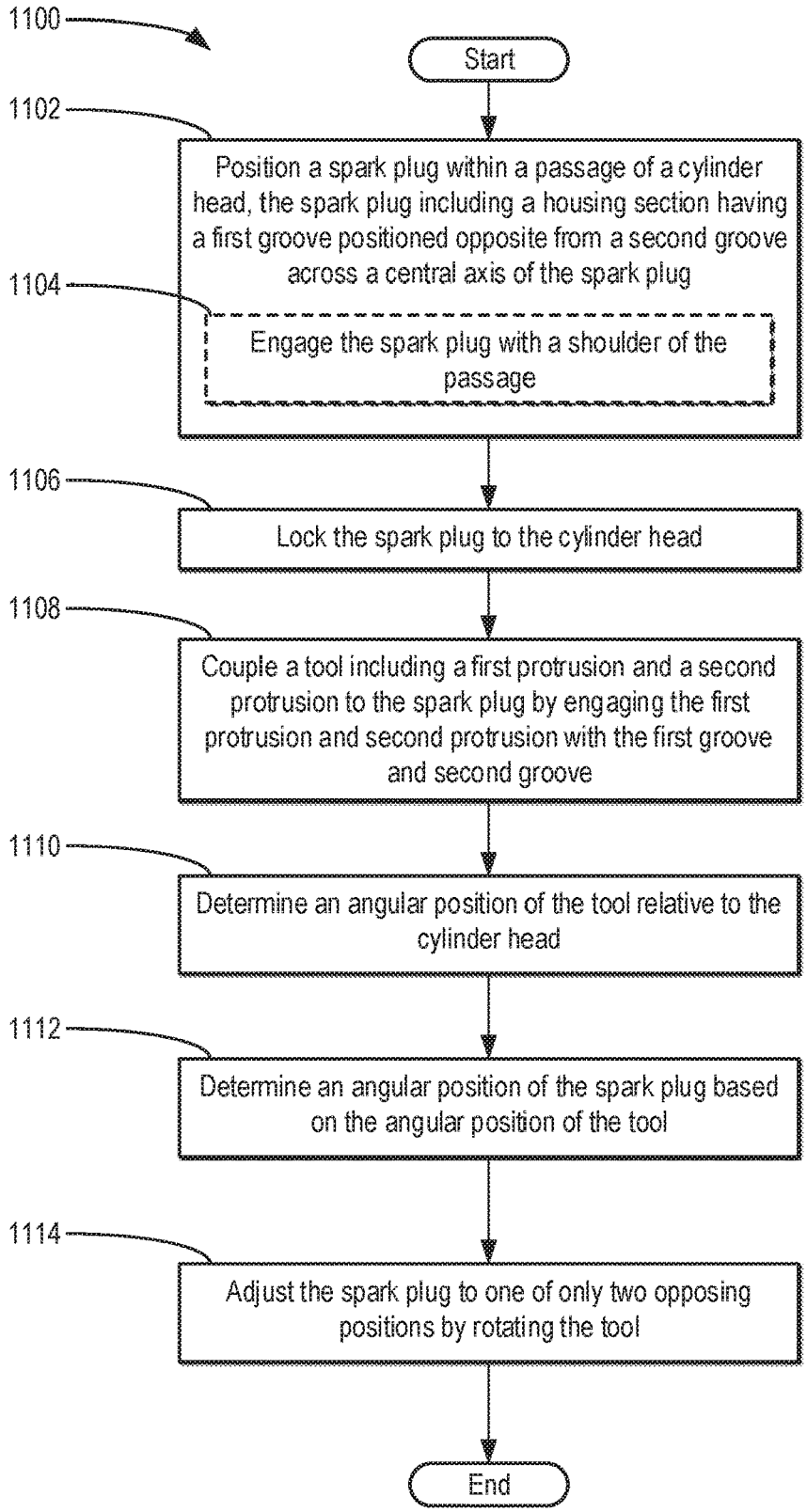
FIG. 11 shows a flowchart illustrating a method of coupling a spark plug to a cylinder head.

The following description relates to systems and methods for a spark plug of an internal combustion engine. An engine, such as the engine shown by FIG. 1, includes at least one combustion chamber capped by a cylinder head. The engine further includes at least one spark plug, such as the spark plug shown by FIGS. 2-3, coupled to the cylinder head, with each spark plug extending into a corresponding combustion chamber of the engine. Each spark plug includes a plurality of mating features adapted to engage with counterpart mating features of a tool, such as the tool shown by FIG. 5, in order to indicate and maintain a position of the spark plug relative to the tool during coupling of the spark plug to the cylinder head. In one example, the mating features of the spark plug includes a pair of grooves, as shown by FIGS. 2-4, and the counterpart mating features of the tool includes a pair of protrusions shaped to engage with the pair of grooves, as shown by FIG. 6. While the mating features of the spark plug are engaged with the counterpart mating features of the tool, the spark plug may be driven by the tool in order to position a ground electrode of the spark plug, as shown by FIG. 7, within the combustion chamber capped by the cylinder head, as shown by FIG. 8. In one example, an assembly robot, such as the assembly robot shown by FIG. 8, may be driven to couple the spark plug to the cylinder head and adjust the position of the spark plug via the tool. The ground electrode is positioned in one of two opposing positions within the cylinder head, as shown by FIGS. 9-10. The position of the tool indicates the position of the ground electrode while the tool is mated with the spark plug. By coupling the spark plug to the cylinder head via the tool (as illustrated by the flowchart of FIG. 11), the position of the ground electrode within the combustion chamber is more precisely controlled. In this way, the position of the ground electrode is adjusted to either of the two opposing positions which may result in increased engine performance and/or combustion stability.

Figure 1:
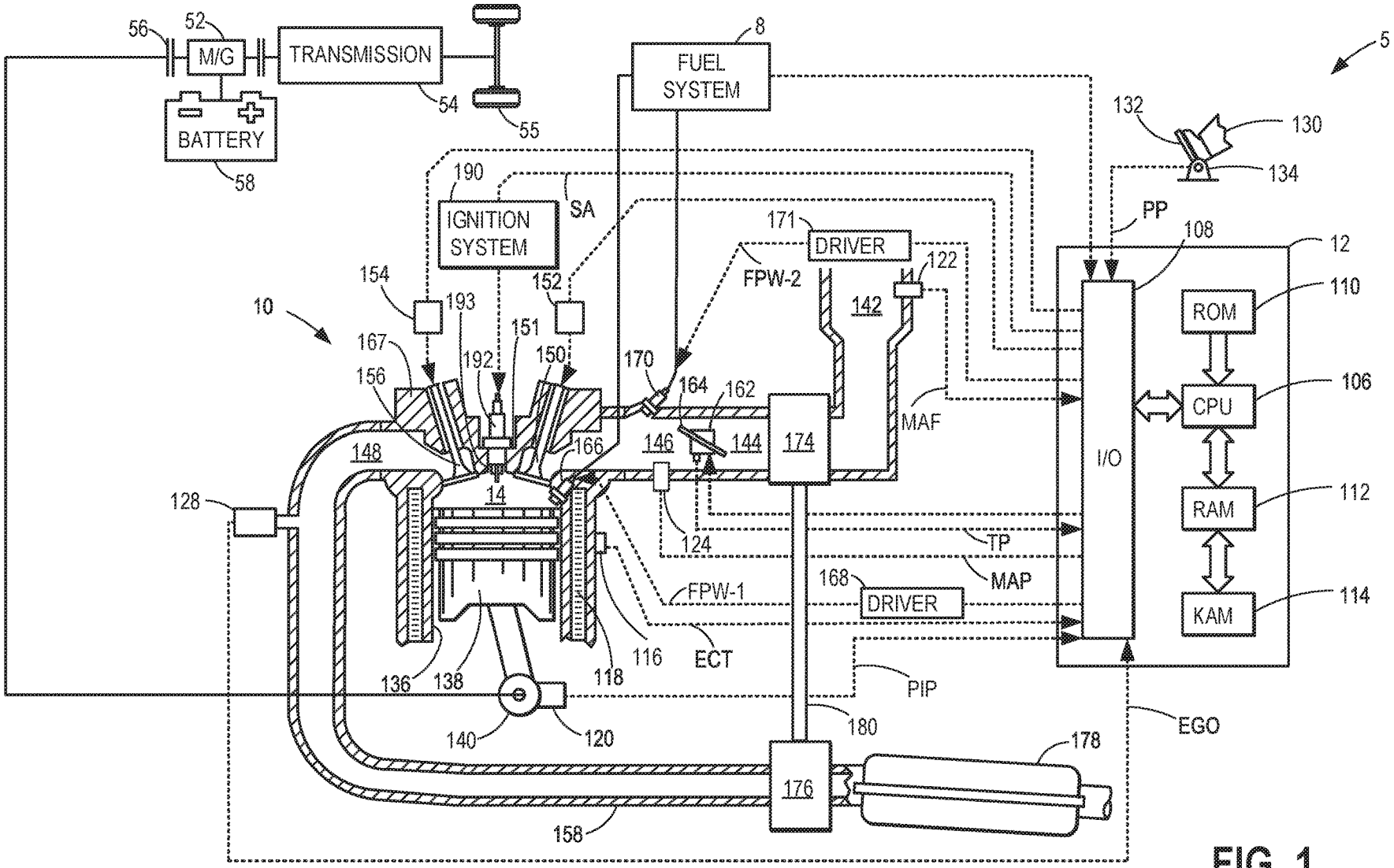
FIG. 1 schematically shows an engine system including a cylinder head and a spark plug.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 formed by an engine block 169 of the engine 10 and capped by cylinder head 167. Cylinder 14 includes piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. Spark plug 192 may be disposed within passage 193 of cylinder head 167 (e.g., coupled to the cylinder head 167 and extending through the passage 193 into combustion chamber 14).

Each cylinder of engine 10 is configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. Fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192 (e.g., similar to the examples shown by FIGS. 2-10 and described below). Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternative example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as Eli) (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature. The controller 12 receives signals from the various sensors of FIG. 1 and employs the various actuators of FIG. 1 to adjust engine operation based on the received signals and instructions stored on a memory of the controller.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Figure 5:
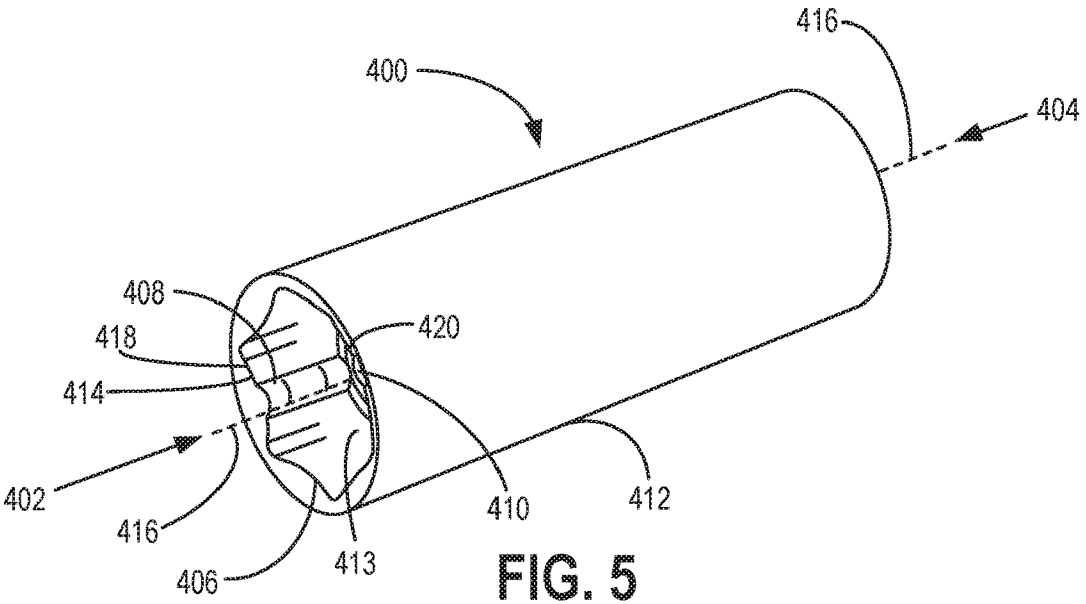
FIG. 5 shows a perspective view of a tool adapted to engage with the spark plug of FIGS. 2-4.
Figure 6:
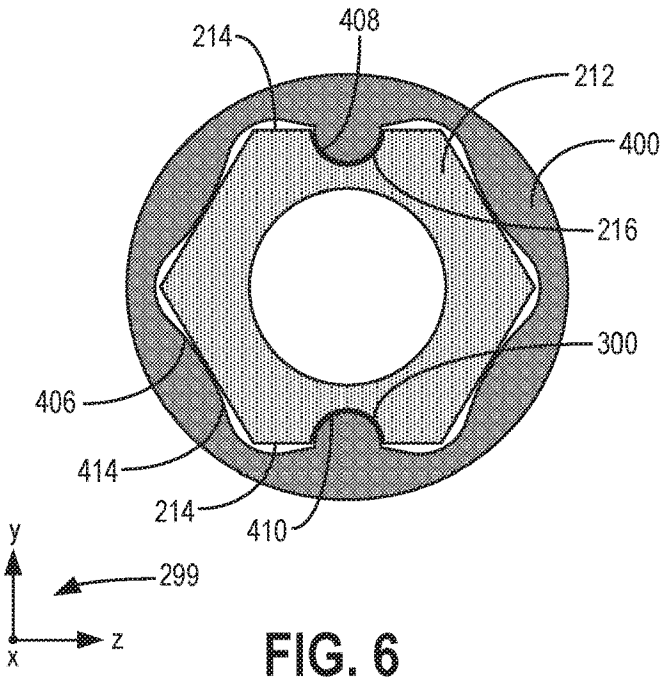
FIG. 6 shows a cross-sectional view of the tool of FIG. 5 engaged with the spark plug of FIGS. 2-4.

Turning now to the other figures, FIGS. 2-3 show different side views of a spark plug 200, FIG. 4 shows an end view of the spark plug 200, FIG. 5 shows a perspective view of a tool 400 adapted to engage with the spark plug 200, FIG. 6 shows a cross-sectional view of the spark plug 200 engaged with the tool 400, FIG. 7 shows an enlarged view of a first end 202 (which may be referred to herein as an electrode end) of the spark plug 200, FIG. 8 shows the spark plug 200 coupled to a cylinder head 750 with the cylinder head 750 shown partially in cross-section, and FIGS. 9-10 show the spark plug 200 coupled to a cylinder head 800 in two different positions. Reference axes 299 are provided in FIGS. 2-4 and 6-9 for relative comparison of the views shown. With regard to FIGS. 2-3, FIG. 2 shows a first side view of the spark plug 200 and FIG. 3 shows a second side view of the spark plug 200, with the second side view being from a different angle around central axis 206 of the spark plug 200 relative to the first side view. The central axis 206 is centered with respect to the spark plug 200 and extends along a length of the spark plug from first end 202 to second end 204. The x-axis of reference axes 299 is arranged parallel to the central axis 206. In some examples, spark plug 200 may be similar to the spark plug 192 described above with reference to FIG. 1.

Spark plug 200 includes a terminal 208 positioned at second end 204 of the spark plug 200 and a ground electrode 228 positioned at first end 202 of the spark plug 200. During conditions in which the spark plug 200 is coupled to a cylinder head of an engine (e.g., the cylinder head 167 of engine 10 shown by FIG. 1 and described above), terminal 208 may be electrically coupled to an ignition system (e.g., ignition system 190 shown by FIG. 1 and described above) of the engine via one or more wires, electrical fittings, etc. Ground electrode 228 may extend into a combustion chamber capped by the cylinder head (e.g., combustion chamber 14 shown by FIG. 1 and described above), and the ignition system may energize the spark plug in response to signals (e.g., electrical signals) transmitted to the ignition system by a controller of the engine (e.g., controller 12 shown by FIG. 1 and described above) in order to produce a spark at the first end 202 of the spark plug 200 and ignite an air/fuel charge within the combustion chamber. Specifically, electrical energy (e.g., electrical current) may flow from the ignition system through terminal 208 to a center electrode 226 of the spark plug 200. Electrical charge positioned at the center electrode 226 may result in a spark across a gap 229 (e.g., a clearance) between a tip 231 of the center electrode 226 and a tip 227 of the ground electrode 228. FIG. 7 shows the clearance 229 in greater detail, with the clearance 229 positioned between axis 704 and axis 702. Axis 704 extends radially from center electrode 226, and axis 702 extends parallel to axis 704 and outward from end surface 230 of the ground electrode 228. Both of axis 704 and axis 702 intersect the central axis 206. The controller may adjust the amount (e.g., frequency, duration, etc.) of electrical energy provided to the terminal 208 from the ignition system in order to adjust a spark timing of the spark plug 200 (e.g., a timing, frequency, etc. of sparks produced at the gap 229 between the center electrode 226 and ground electrode 228).

In order to couple with the cylinder head, spark plug 200 includes a threaded section 220 including a plurality of threads 222. In the examples shown, threaded section 220 is positioned closer to the first end 202 than the second end 204 and is coupled with (e.g., joined to) housing section 212. In one example, housing section 212 and threaded section 220 may be formed together as a single unit (e.g., molded together). In other examples, housing section 212 may be formed separately and coupled (e.g., fused, welded, etc.) to threaded section 220. In other examples, the threaded section 220 may be positioned differently (e.g., closer to the second end 204 than the first end 202, or positioned a same distance from first end 202 and second end 204). Further, in other examples, a number of the threads 222 included by the threaded section 220 and/or a relative spacing of the threads 222 may be different than the example shown by the figures.

The cylinder head may include a plurality of counterpart threads configured to engage with the threads 222 of the spark plug 200 in order to maintain a position of the spark plug 200 relative to the cylinder head during conditions in which the spark plug 200 is coupled to the cylinder head. For example, the cylinder head may include a passage (e.g., passage 193 shown by FIG. 1 and described above), and the passage may include the counterpart threads. The spark plug 200 may be inserted (e.g., threaded) into the passage such that the threads 222 of the spark plug 200 engage with the counterpart threads and lock the spark plug 200 within the passage.

During conditions in which the spark plug 200 is coupled to the cylinder head (e.g., positioned within the passage of the cylinder head, with the threads 222 engaged with the counterpart threads of the passage), radial extension 218 of the spark plug may abut a portion of the cylinder head. For example, turning momentarily to FIG. 8, spark plug 200 is shown coupled to cylinder head 750. In one example, cylinder head 750 may be similar to the cylinder head 167 shown by FIG. 1 and described above. Cylinder head 750 includes intake passage 751, intake valve 753, exhaust passage 752, and exhaust valve 754 (which may be similar to intake passage 146, intake valve 150, exhaust passage 148, and exhaust valve 156, respectively, shown by FIG. 1 and described above). Cylinder head 750 further includes passage 756 having opening 757 at an exterior surface 765 of the cylinder head 750, with the passage 756 adapted to receive the spark plug 200. The opening 757 has diameter 760, with the diameter 760 being greater than diameter 761 of the radial extension 218 of the spark plug 200.

The passage 756 may have a length 777 from opening 757 to opening 766 greater than a length of the spark plug 200 (e.g., the length of the spark plug in the direction of central axis 206), with the opening 766 positioned at combustion chamber 759. The passage 756 may include a shoulder 763 (e.g., similar to shoulder 151 shown by FIG. 1). The shoulder 763 may be an annular portion of the passage that is narrower than opening 757 of the passage 756 (e.g., the opening 757 through which the spark plug 200 is inserted) but does not close the passage 756, such that the threaded section 220 of the spark plug 200 may be inserted through the passage 756 and past the shoulder 763 to engage with counterpart threads 758 of the passage 756. However, a diameter 249 of the radial extension 218 (shown by FIGS. 2-3) may be greater than the diameter 761 of the passage 756 at the shoulder 763. In this configuration, the radial extension 218 may abut the shoulder 763 (e.g., be positioned in face-sharing contact with the shoulder 763) and maintain the depth of insertion of the spark plug 200 into the passage 756 (e.g., lock the spark plug 200 from being inserted further into the passage 756). Further, a diameter 764 of the opening 766 may be less than the diameter 761 of the passage 756 at the shoulder 763, with the first end 202 of the spark plug 200 configured to protrude from the opening 766 into the combustion chamber 759. The shoulder 763 and counterpart threads 758 may not include slots or protrusions shaped to receive the first and second mating features of the spark plug described below. For example, shoulder 763 and counterpart threads 758 may not include protrusions shaped to fit within the grooves of the housing section 212 described below.

Returning now to FIGS. 2-3, spark plug 200 includes housing section 212 positioned between first end 202 and second end 204. Housing section 212 includes a plurality of planar surfaces 214, with each planar surface 214 positioned at an angle relative to each adjacent planar surface 214. The planar surfaces 214 are arranged annularly around the central axis 206 of the spark plug 200 (e.g., positioned to encircle the central axis 206 of the spark plug 200). In one example, the housing section 212 includes six planar surfaces 214, with each planar surface 214 angled by 60 degrees relative to each adjacent planar surface 214 such that the housing section 212 has an approximately hexagonal cross-section (e.g., a cross-section along axis 234, as shown by FIG. 6). In other examples, the housing section 212 may include a different number of planar surfaces 214 (e.g., five, seven, etc.). In the examples shown, each planar surface 214 has a same size (e.g., width and length) relative to each other planar surface 214 of the housing section 212. However, in other examples, one or more of the planar surfaces 214 may have a different size relative to one or more other planar surfaces 214, as described further below.

The housing section 212 is arranged between terminal 208 of the spark plug 200 and radial protrusion 218 of the spark plug 200. The radial protrusion 218 is arranged between the housing section 212 and ground electrode 228 of the spark plug 200 in the direction of the central axis 206 (e.g., the direction parallel to the center axis 206). The threaded section 212 is positioned between the radial protrusion 218 and the ground electrode 228.

The housing section 212 further includes a first groove 216 (e.g., slot, depression, recess, etc.) as shown by FIG. 2 and a second groove 300 as shown by FIG. 3. The first groove 216 and second groove 300 may be referred to herein as mating features. The first groove 216 and second groove 300 are shown positioned at opposing sides of the housing section 212 (e.g., at opposite sides of the housing section 212 across the central axis 206) and may be the only grooves included by the housing section 212 (e.g., housing section 212 may include first groove 216 and second groove 300, and no other grooves). Each of the first groove 216 and second groove 300 are included in a corresponding planar surface of the housing section 212 (e.g., first groove 216 is included in a first planar surface, and second groove 300 is included in an opposing, second planar surface, the first planar surface parallel with the second planar surface). The first groove 216 may be centered in the first planar surface and the second groove 300 may be centered in the second planar surface, with each of the first groove 216 and second groove 300 each extending inward toward central axis 206 of the spark plug 200.

In the examples shown, the second groove 300 is radially aligned with a base 224 of the ground electrode 228 (e.g., a portion of the ground electrode 228 joining the ground electrode 228 to a rim 232 of the spark plug 200 at the first end 202). Specifically, an axis (which may be referred to herein as a second axis) extending radially relative to the central axis 206 and intercepting a center of the base 224 of the ground electrode 228 is arranged parallel with an axis (which may be referred to herein as a first axis, parallel with the second axis) extending radially relative to the central axis 206 and intercepting center 215 of the first groove 216 and center 219 of the second groove 300 (e.g., as illustrated by axis 401 aligned radially with the center of the base 224 and the center 219 of the second groove 300, shown by FIG. 4). An angle between the center of the base 224 and the center 219 of the second groove 300 around the central axis 206 may be zero. The ground electrode 228 extends (e.g., curves) from the base 224 toward the central axis 206 of the spark plug 200 and terminates at end surface 230. The center 215 of the first groove 216 may be offset from the center 219 of the second groove 300 by 180 degrees around the central axis 206. The first groove 216 is positioned radially opposite to the second groove 300, such that the axis extending radially from the central axis 206 and intercepting the center 219 of the second groove 300 additionally intercepts a center 215 of the first groove 216. The center 215 of the first groove 216 may be positioned 180 degrees around the central axis 206 relative to the center 219 of the second groove 300.

In other examples, the second groove 300 may not be radially aligned with the base 224 of the ground electrode 228 as described above and may instead be positioned at an angle from the base 224 around the central axis 206. In one example, the second groove 300 may be positioned at 90 degrees around the central axis 206 relative to the base 224. In another example, the second groove 300 may be positioned at 120 degrees around the central axis relative to the base 224. However, in each example, the first groove 216 is positioned radially opposite to the second groove 300 across the central axis 206 as described above. Positioning the first groove 216 radially opposite to the second groove 300 enables the position of the spark plug 200 to be more easily adjusted to one of only two different positions during installation (e.g., coupling) of the spark plug 200 to the cylinder head, as described further below.

FIG. 4 shows a view of the spark plug 200 from the first end 202, with the position of the housing section 212 indicated in dashed lines. As shown by axis 401, the second groove 300 is positioned opposite to the first groove 216 across the central axis 206. The relative positioning of the first groove 216 and second groove 300 enables tool 400 (shown by FIG. 5) to couple with the spark plug 200 for installing the spark plug 200 within the cylinder head.

As shown by FIG. 5, tool 400 includes an opening 414 positioned at a first end 402. A body 412 of the tool 400 extends from the first end 402 to an opposing, second end 404. The opening 414 is shaped to couple around the housing section 212 of the spark plug 200 (e.g., encircle the housing section 212 of the spark plug 200). For example, tool 400 may be inserted over the spark plug 200, with the terminal 208 and housing section 212 passing through the opening 414 into an interior 413 of the tool 400. The tool 400 includes a plurality of inner surfaces 406 configured to engage with the planar surfaces 214 of the housing section 212 (as further illustrated by FIG. 6). For example, tool 400 may include a same number and relative arrangement of inner surfaces 406 compared to the number and relative arrangement of the planar surfaces 214. As one example, the housing section 212 may include six planar surfaces 214 as described above and shown by FIGS. 2-4, with each planar surface 214 angled relative to each adjacent planar surface 214 by 60 degrees. Similarly, the tool 400 may include six inner surfaces 406, with each inner surface 406 angled relative to each adjacent inner surface 406 by 60 degrees. In this configuration, each inner surface 406 engages with a corresponding planar surface 214 of the housing section 212 during conditions in which the tool 400 is coupled with the spark plug 200.

The tool 400 additionally includes a first protrusion 408 and a second protrusion 410 extending toward central axis 416 of the tool 400 from respective inner surfaces 406 of the tool. The first protrusion 408 and second protrusion 410 may be referred to herein as counterpart mating features. The first protrusion 408 is positioned radially opposite to the second protrusion 410 across central axis 416 of the tool 400 (e.g., the first protrusion 408 extends from a first inner surface 418 of the inner surfaces 406 and the second protrusion 410 extends from a second inner surface 420 of the inner surfaces 406, with the first inner surface positioned opposite to the second inner surface across the central axis 416). During conditions in which the tool 400 is coupled to the spark plug 200, central axis 416 is positioned parallel and coaxial with central axis 206 of the spark plug 200. As the tool 400 engages with the spark plug 200 (e.g., as the terminal 208 and housing section 212 of the spark plug 200 are inserted through the opening 414 of the tool 400), the first protrusion 408 engages with one of the first groove 216 or second groove 300, and the second protrusion 410 engages with the other of first groove 216 or second groove 300 that is not engaged with the first protrusion 408. Specifically, tool 400 may couple with the spark plug 200 in a first configuration such that the first protrusion 408 is engaged with the first groove 216 (e.g., is seated within the first groove 216, in face-sharing contact with surfaces of the first groove 216, as shown by FIG. 6) and the second protrusion 410 is engaged with the second groove 300 (e.g., is seated within the second groove 300, in face-sharing contact with surfaces of the second groove 300, as shown by FIG. 6), and the tool 400 may alternatively couple with the spark plug 200 in a second configuration in which the first protrusion 408 is engaged with the second groove 300 and the second protrusion 410 is engaged with the first groove 216.

Each of the protrusions (e.g., first protrusion 408 and second protrusion 410) may be centered relative to their respective inner surfaces 406 of the tool 400. For example, first protrusion 408 may be positioned at a center or midpoint of the first inner surface 418 described above, and second protrusion 410 may be positioned at a center or midpoint of the second inner surface 420 described above. The first protrusion 408 and second protrusion 410 may each extend an entire length of the first inner surface 418 and second inner surface 420, respectively, in an axial direction of the central axis 416 (e.g., a direction parallel to the central axis 416).

During conditions in which the tool 400 is engaged with the spark plug 200 as described above (e.g., as shown by FIG. 6), the tool 400 may be rotated (e.g., turned along central axis 416, with central axis 416 being the axis of rotation of the tool 400) in order to rotate the spark plug 200. Specifically, the inner surfaces 406 of the tool 400 engage with the planar surfaces 214 of the housing section 212 such that force applied to the tool 400 (e.g., turning force) is transmitted by the tool 400 to the spark plug 200 (e.g., the inner surfaces 406 of the tool 400 press against the planar surfaces 214 of the housing section 212 as force is applied to the tool 400 to rotate the tool 400, and as the inner surfaces 406 rotate, the entire spark plug 200 similarly rotates). Driving (e.g., rotating) the spark plug 200 via the tool 400 as described above may couple the spark plug 200 to the cylinder head (e.g., cylinder head 750 shown by FIG. 8 and described above). For example, rotating the spark plug 200 via the tool 400 may engage the threads 222 of the spark plug 200 with the counterpart threaded surfaces of the cylinder head (e.g., counterpart threads 758 shown by FIG. 8 and described above) in order to drive the spark plug 200 toward the combustion chamber of the engine (e.g., to position the ground electrode 228 of the spark plug 200 within the combustion chamber).

By configuring the tool 400 to include the first protrusion 408 and second protrusion 410 adapted to engage with the first groove 216 and second groove 300, the tool 400 may couple with the spark plug 200 in only two positions, as described above. Specifically, the tool 400 may couple with the spark plug 200 in the first position in which the first protrusion 408 is engaged with (e.g., seated within) the first groove 216 and the second protrusion 410 is engaged with (e.g., seated within) the second groove 300. The tool 400 may additionally couple with the spark plug 200 in the second position in which the first protrusion 408 is engaged with the second groove 300 and the second protrusion 410 is engaged with the first groove 216. As described above with reference to FIGS. 2-3, the first groove 216 and second groove 300 are positioned opposite to each other across central axis 206 of the spark plug 200, and the first groove 216 is positioned at a known angle relative to the base 224 of the ground electrode 228 (e.g., the first groove 216 may be radially aligned with the base 224 of the ground electrode 228, such that an angle around the central axis 206 between the center 215 of the first groove 216 and a center or midpoint of the base 224 of the ground electrode 228 is zero). Because the second groove 300 is positioned opposite to the first groove 216 across the central axis 206, an angle between the center 215 of the first groove 216 and the center 219 of the second groove 300 is 180 degrees.

In this configuration, during conditions in which the tool 400 is coupled to the spark plug 200, one of the first protrusion 408 or the second protrusion 410 is radially aligned with the base 224 of the ground electrode 228. Specifically, during conditions in which the first protrusion 408 is engaged with the first groove 216 and the second protrusion 410 is engaged with the second groove 300, the first protrusion 408 is radially aligned with the base 224 of the ground electrode 228. During conditions in which the second protrusion 410 is engaged with the first groove 216 and the first protrusion 408 is engaged with the second groove 300, the second protrusion 410 is radially aligned with the base 224 of the ground electrode 228. By configuring one of the protrusions (e.g., either first protrusion 408 or second protrusion 410) to be radially aligned with the base 224 of the ground electrode 228 and configuring the other protrusion (e.g., the other of first protrusion 408 or second protrusion 410) to be positioned radially opposite to the base 224 of the ground electrode 228 (e.g., opposite across the central axis 206 of the spark plug 200), the position of the ground electrode 228 (e.g., the position of the base 224 of the ground electrode 228) may be determined based on the position of the tool 400 (e.g., the amount of rotation of the tool 400), as described further below with regard to FIGS. 9-10.

In some examples, one or more of the planar surfaces 214 may be sized differently relative to one or more other planar surfaces 214 of the housing section 212. For example, housing section 212 may include six planar surfaces 214, with two of the planar surfaces 214 having a larger surface area (e.g., a larger length in directions perpendicular to the central axis 206) relative to each other planar surface 214. In such examples, tool 400 may include a similar arrangement of inner surfaces 406. For example, two of the inner surfaces 406 of the tool 400 may have a larger surface area (e.g., a larger length in directions perpendicular to the central axis 416) than each other inner surface 406. The inner surfaces 406 having the larger surface area may be shaped to engage with the planar surfaces 214 of the housing section 212 having the larger surface area, such that the tool 400 engages with the spark plug 200 in only two positions, similar to the examples described above. For example, one of the planar surfaces 214 having the larger surface area may be radially aligned with the base 224 of the electrode 228, similar to the radial alignment of the second groove 300 with the base 224 of the electrode 228 as described above. In this way, similar to the example described above, the position of the ground electrode 228 (e.g., the position of the base 224 of the ground electrode 228) may be determined based on the position of the tool 400 (e.g., the amount of rotation of the tool 400) while the tool 400 is engaged with the spark plug 200 (e.g., the inner surfaces 406 having the larger surface area are engaged with the planar surfaces 214 having the larger surface area). In yet other examples, instead of having a larger surface area, the two planar surfaces 214 may have a smaller surface area relative to each other planar surface 214, and the corresponding two inner surfaces 406 configured to engage with the two planar surfaces 214 may have a smaller surface area relative to each other inner surface 406.

In yet other examples, first groove 216 and second groove 300 may instead be corresponding protrusions of the spark plug 200, and first protrusion 408 and second protrusion 410 of the tool 400 may instead be corresponding grooves shaped to engage with the corresponding protrusions of the spark plug 200. In such configurations, the tool 400 may still only engage with the spark plug 200 in the two positions described herein (e.g., with the first protrusion of the spark plug 200 engaging with the first groove of the tool 400 and the second protrusion of the spark plug 200 engaging with the second groove of the tool 400, or with the first protrusion of the spark plug 200 engaging with the second groove of the tool 400 and the second protrusion of the spark plug engaging with the first groove of the tool 400).

FIGS. 9-10 show two different positions of the ground electrode 228 during conditions in which the spark plug 200 is coupled to cylinder head 800. In one example, cylinder head 800 may be similar to cylinder head 750 shown by FIG. 8 and/or cylinder head 167 shown by FIG. 1 and described above. FIGS. 9-10 illustrate a surface 802 of the cylinder head 800 positioned at a top of a combustion chamber capped by the cylinder head 800 (e.g., the surface of the combustion chamber positioned vertically above a piston disposed within the combustion chamber, such as piston 138 shown by FIG. 1 and described above). The cylinder head 800 includes a first intake valve 808, a second intake valve 810, a first exhaust valve 804, and a second exhaust valve 806. In one example, first intake valve 808 and second intake valve 810 may each be similar to intake valve 150 shown by FIG. 1 and described above, and first exhaust valve 804 and second exhaust valve 806 may each be similar to exhaust valve 156 shown by FIG. 1 and described above. Cylinder head 800 further includes fuel injector 812 positioned between the second intake valve 810 and the second exhaust valve 806. In other examples, fuel injector 812 may be positioned differently (e.g., between first intake valve 808 and first exhaust valve 804). In yet other examples, cylinder head 800 may not include the fuel injector 812. Further, in some examples, cylinder head 800 may include only one intake valve and only one exhaust valve (e.g., one of first intake valve 808 or second intake valve 810, and one of first exhaust valve 804 or second exhaust valve 806).

In the examples shown by FIGS. 9-10, first intake valve 808 and second intake valve 810 are each centered along axis 854 (e.g., axis 854 intersects midpoint 860 of first intake valve 808 and midpoint 862 of second intake valve 810), and first exhaust valve 804 and second exhaust valve 806 are each centered along axis 850 (e.g., axis 850 intersects midpoint 856 of first exhaust valve 804 and midpoint 858 of second exhaust valve 806). The axis 854 is parallel to axis 850 and offset (e.g., spaced apart) from axis 850. In this configuration, the first intake valve 808 and second intake valve 810 are aligned (e.g., centered) along axis 854, and the first exhaust valve 804 and second exhaust valve 806 are aligned (e.g., centered) along axis 850.

FIGS. 9-10 further show axis 852, with the axis 852 positioned midway between axis 850 and axis 854. Axis 852 is parallel with each of axis 852 and axis 850 and may be positioned a same length 864 from each of axis 852 and axis 850. In the configurations shown by FIGS. 9-10, the center of the base 224 of the ground electrode 228 is intersected by the axis 852. Additionally, the central axis 206 of the spark plug 200 is intersected by the axis 852.

With the spark plug 200 in the first position shown by FIG. 9 or the second position shown by FIG. 10 (with the second position being offset from the first position by 180 degrees around the central axis 206 of the spark plug 200, such that the spark plug is rotated by 180 degrees around the central axis 206 in the second position relative to the first position), engine performance may be increased. For example, positioning the spark plug 200 in the first position or the second position may increase an arc length of a spark produced by the spark plug 200 and/or increase a flow speed of intake air charge into the combustion chamber. Further, by positioning the spark plug 200 in the first position or the second position, a flow rate of fuel/air charge within the combustion chamber through the clearance 229 (shown by FIGS. 2 and 7 and described above) may be increased, which may result in an increased combustion stability and/or a more precise combustion timing. As one example, during conditions in which the first intake valve 808 and/or second intake valve 810 is moved from a fully closed position to an opened position in order to flow intake air into the combustion chamber (e.g., from an intake air passage, such as intake passage 146 shown by FIG. 1 and described above), the intake air may mix with fuel injected into the combustion chamber by fuel injector 812 and may flow at an increased rate through clearance 229 while the spark plug 200 is in the first position or the second position relative to conditions in which the spark plug 200 is not in the first position or second position (e.g., conditions in which the spark plug 200 is rotated by 90 degrees relative to the first position or the second position).

In some examples, the spark plug 200 may be adjusted to the first position shown by FIG. 9 or the second position shown by FIG. 10 during coupling of the spark plug 200 to the cylinder head 800 without visual inspection of the spark plug 200. For example, as described above, cylinder head 800 may be similar to the cylinder head 750 shown by FIG. 8 and may include similar passages, openings, etc. (e.g., similar to passage 756, opening 757, opening 766, shoulder 763, etc.). An opening adapted to receive the spark plug 200 may have a length greater than a length of the spark plug 200, similar to the example described above with reference to FIG. 8 (e.g., passage 756 having length 777). As a result, it may be difficult for an operator (e.g., engine assembly line operator) to visually determine the position of the spark plug 200 relative to the cylinder head 800 during conditions in which the spark plug 200 is seated within the passage and coupled to the cylinder head 800 (e.g., via threads of the spark plug engaged with counterpart threads of the cylinder head, similar to threads 222 and counterpart threads 758 described above with reference to FIG. 8). By configuring the spark plug 200 to engage with the tool 400 as described above, the position of the spark plug 200 (e.g., the orientation of the ground electrode 228 of the spark plug 200) during conditions in which the spark plug 200 is coupled to the cylinder head 800 may be more easily adjusted.

For example, during assembly of the engine (e.g., the engine including the spark plug 200 and cylinder head 800, similar to engine 10 shown by FIG. 1 and described above), spark plug 200 may be coupled to the cylinder head 800 by a computer controlled assembly robot (e.g., a robotic arm) via the tool 400 (described above with reference to FIGS. 5-6). As one example, the assembly robot may be assembly robot 791 shown schematically by inset 790 of FIG. 8. Assembly robot 791 may be a robot on an engine assembly line, in one example. Assembly robot 791 may include an electronic controller (e.g., a computer including one or more processors or CPUs) including non-transitory computer memory (e.g., read-only memory and/or random access memory). The non-transitory computer memory may include instructions for driving the assembly robot 791 (e.g., actuating one or more arms or other components of the robot) according to the methods described herein. As one example, assembly robot 791 may include instructions stored in non-transitory memory to perform the method 1100 described below with reference to FIG. 11.

Assembly robot 791 may include one or more arms adapted to adjust a position of the spark plug 200. For example, tool 400 may be mounted to an end 796 of arm 798, and the position of the arm 798 may be adjusted by the electronic controller in order to adjust the position of the spark plug 200 during conditions in which the tool 400 is coupled to the spark plug 200 (e.g., as described above). In other examples, assembly robot 791 may include one or more components (e.g., clamps, pincers, etc.) shaped to temporarily couple with (e.g., grasp) the spark plug 200 (e.g., terminal 208 and/or housing section 212 of the spark plug 200) in order to adjust the position of the spark plug 200 independently relative to the position of the tool 400. As one non-limiting example, assembly robot 791 may include a clamp mounted to arm 798 at a first section of the arm 798, and may further include tool 400 mounted to arm 798 at a second section of the arm 798 (e.g., the end 796). The electronic controller may rotate the first section and/or second section in order to couple either of the clamp or the tool 400 with the spark plug 200. As one example, the electronic controller may drive the assembly robot 791 to couple the clamp with the tool 400 and to position the spark plug 200 in an initial position within the cylinder head (e.g., cylinder head 750). The electronic controller may then drive the assembly robot 791 to decouple the clamp from the spark plug 200 and to couple the tool 400 with the spark plug 200 to adjust the spark plug to either of the two coupled positions shown by FIGS. 9-10.

In the example shown by FIGS. 9-10, the non-transitory computer memory of the electronic controller of the assembly robot (e.g., assembly robot 791) may include instructions for coupling the spark plug 200 to the cylinder head 800 in either of the first position shown by FIG. 9 or the second position shown by FIG. 10. The controller may send electronic control signals (e.g., electrical signals) to the assembly robot (e.g., one or more actuators of arm 798 of the assembly robot 791) in order to adjust the assembly robot into different positions (e.g., adjust a position of the arm 798 of the assembly robot 791). For example, while coupling the spark plug 200 to the cylinder head 800, the spark plug 200 may be positioned in an initial position which is not either of the first position or the second position (e.g., with the axis 852 not intersecting the center of the base 224 of the ground electrode 228) by engaging threads 222 of the spark plug 200 with counterpart threads (e.g., similar to counterpart threads 758) of the cylinder head 800. The assembly robot may adjust the position of the spark plug 200 to one of the first position or second position via electronic signals transmitted to the assembly robot by the electronic controller based on the instructions stored in the non-transitory memory of the electronic controller. For example, the controller may direct the assembly robot 791 to rotate the tool 400 (e.g., by rotating arm 798) during conditions in which the tool 400 is coupled with the spark plug 200.

The assembly robot 791 may include a plurality of different pivots in order to increase a precision of adjusting the position of the spark plug 200 via actuation of the arm 798. For example, as shown by inset 790 of FIG. 8, assembly robot 791 may include a first pivot 794, a second pivot 793, and a third pivot 792. Assembly robot 791 may include a base 785 fixedly coupled to support surface 784, with a first section 781 being pivotable relative to the base 785 via first pivot 794, a second section 782 coupled to the first section 781 and pivotable relative to the first section 781 via second pivot 793, and a third section 783 coupled to the second section 782 and pivotable relative to the second section 782 via third pivot 792. Further, end 796 of the arm 798 may rotate relative to the second section 782 along rotational axis 797 (e.g., in order to adjust the angular position of the spark plug 200 and/or tool 400 within the cylinder head). In some examples, one or more sections of the assembly robot 791 (e.g., first section 781, second section 782, and/or third section 783) may include one or more components adapted to enable a length of the one or more sections to be adjusted via actuation by the electronic controller. For example, second section 782 may include one or more telescoping components configured to shorten or elongate a length of the second section 782 in response to signals (e.g., electrical signals) transmitted to actuators of the assembly robot 791 by the electronic controller. In the configuration described above, the instructions stored in the non-transitory memory of the electronic controller may be executed in order to drive the assembly robot 791 to couple the spark plug 200 to the cylinder head (e.g., cylinder head 750) via the tool 400, as indicated by dashed line 795.

Because the tool 400 is configured to engage with the spark plug 200 in only two configurations (e.g., the first configuration in which the first protrusion 408 is engaged with the first groove 216 and the second protrusion 410 is engaged with the second groove 300, or the second configuration in which the first protrusion 408 is engaged with the second groove 300 and the second protrusion 410 is engaged with the first groove 216, as described above with reference to FIGS. 5-6), and because the second groove 300 may be radially aligned with the base 224 of the ground electrode 228, during conditions in which the tool 400 is coupled to the spark plug 200, the position of the ground electrode 228 may be determined by the electronic controller based on an amount of rotation of the tool 400 relative to the cylinder head 800. The amount of rotation of the tool 400 relative to the cylinder head 800 corresponds to an angular position of components of the tool 400 relative to components of the cylinder head 800. For example, during conditions in which the tool 400 is coupled to the spark plug 200, the central axis 416 of the tool 400 (shown by FIG. 5) may be positioned coaxially relative to a central axis of the passage of the cylinder head in which the spark plug 200 is disposed (e.g., similar to axis 780 of cylinder head 750 shown by FIG. 8). The position of the first protrusion 408 and/or second protrusion 410 relative to the central axis of the passage may define the amount of rotation of the tool 400 relative to the cylinder head. For example, an angle between the first protrusion 408 and/or second protrusion 410 and an axis extending radially from the central axis of the passage and intersecting the central axis of the passage may define an angle of the tool 400 relative to the cylinder head (e.g., the angular position of the tool 400 relative to the cylinder head). In one example, the axis extending radially from the central axis of the passage may be the axis 852 shown by FIGS. 9-10.

As one example, the initial position of the spark plug 200 relative to the cylinder head 800 (e.g., prior to adjusting the position of the spark plug 200 via the tool 400) may correspond to a position in which the center of the base 224 of the ground electrode 228 is at an angle of 30 degrees relative to the axis 852. The initial position of the spark plug 200 within the cylinder head 800 may be determined based on the angular position of the tool 400 (e.g., the angular position of the tool 400 relative to the cylinder head 800) while the tool 400 is coupled to the spark plug 200 (e.g., in the first configuration or second configuration). For example, the angular position of the tool 400 may be the same as the angular position of the spark plug 200 or offset 180 degrees from the angular position of the spark plug 200, such that base 224 of the ground electrode 228 of the spark plug 200 is either radially aligned with the first protrusion 408 or is positioned 180 degrees around the central axis 206 and central axis 416 (with the central axes 206 and 416 being coaxial while the tool 400 is coupled to the spark plug 200) from the first protrusion 408 while the tool 400 is coupled to the spark plug 200). The assembly robot (e.g., assembly robot 791 described above) may couple the tool 400 to the spark plug 200 in one of the two configurations described above in order to determine the position of the spark plug 200 (e.g., the amount of rotation of the spark plug 200 relative to the cylinder head 800) via the position of the tool 400. For example, the assembly robot may include a position sensor in electronic communication with the controller, with the position sensor adapted to measure the amount of rotation of the spark plug (e.g., an angular position of the spark plug) relative to the cylinder head 800 while the tool 400 is coupled to the spark plug 200 in one of the two configurations. In one example, the position sensor may be positioned at the end 796 of arm 798. In some examples, the assembly robot 791 may include additional position sensors (e.g., in order to determine a relative position of each section of the assembly robot 791) and/or other sensors (e.g., velocity sensors, force sensors, etc.) electronically coupled with the controller (e.g., adapted to receive and/or transmit electronic signals to and/or from the controller).

In order to adjust the position of the spark plug 200 from the initial position described above to one of the two positions shown by FIGS. 9-10, the electronic controller may transmit signals (e.g., electrical signals) to the assembly robot in order to actuate the assembly robot (e.g., energize the arm of the assembly robot) to turn the tool 400 while the tool 400 is coupled to the spark plug 200. The electronic controller may control the assembly robot to rotate the tool 400 to either of two positions in which the protrusions of the tool 400 (e.g., first protrusion 408 and second protrusion 410) are aligned with the axis 852 (e.g., a center or midpoint of each protrusion is intersected by the axis 852). For example, to adjust the spark plug 200 from the initial position in which the center of the base 224 of the ground electrode 228 is angled by 30 degrees relative to the axis 852 to one of the two positions in which the center of the base 224 of the ground electrode 228 is intersected by the axis 852, the controller may control the assembly robot to turn the tool 400 by −30 degrees relative to the initial position in order to turn the spark plug 200 by −30 degrees relative to the initial position. In this way, the base 224 of the ground electrode 228 is adjusted to be aligned with the axis 852 (e.g., intersected by the axis 852), and performance of the engine may be increased during conditions in which the spark plug 200 is energized to ignite fuel and air within the combustion chamber as described above.

By configuring the spark plug 200 to include the first groove 216 and second groove 300 positioned radially opposite to each other, during conditions in which the tool 400 is coupled to the spark plug 200 in order to adjust the position of the spark plug 200 as described above, the tool 400 may be turned by a smaller amount of angle to align the center of the base 224 of the ground electrode 228 with the axis 852 and position the spark plug in the closer of one of the two positions shown by FIGS. 9-10. For example, during conditions in which the spark plug 200 is coupled to the cylinder head 800 in an initial position in which the center of the base 224 of the ground electrode 228 is angled by 50 degrees relative to the axis 852 (e.g., the center of the base 224 is intersected by axis 866 shown by FIG. 10, with the axis 866 intersecting the central axis 206 and being angled by 50 degrees relative to the axis 852), the controller may control the assembly robot to rotate the tool 400 by −50 degrees (e.g., toward the axis 852, in direction 868 around the central axis 206) to the second position (e.g., the position shown by FIG. 10) rather than rotating the tool 400 by 130 degrees (e.g., in direction 870 opposite to the direction 868) toward the first position (e.g., the position shown by FIG. 9). Rotating the tool 400 as described above positions the axis 866 parallel with axes 850 and 854, such that the tool 400 is rotated in the direction 868 until the axis 866 is parallel to axes 850 and 854). By adjusting the position of the spark plug 200 from the initial position in this way, the spark plug 200 is adjusted to one of the first position or the second position with a reduced amount of rotation, resulting in a reduced assembly time of the engine and/or a reduced amount of energization of the assembly robot.

FIG. 11 shows a flowchart illustrating a method 1100 for coupling a spark plug to a cylinder head of an engine via a tool. The spark plug, cylinder head, engine, and tool may be similar to those described above. For example, the spark plug may be similar to spark plug 192 shown by FIG. 1 and described above and/or spark plug 200 described above, the cylinder head may be similar to the cylinder head 167 shown by FIG. 1 and described above, cylinder head 750 shown by FIG. 8, and/or cylinder head 800 shown by FIGS. 9-10, the engine may be similar to engine 10 shown by FIG. 1 and described above, and the tool may be similar to tool 400 shown by FIGS. 5-6 and described above. Instructions for carrying out method 1100 and the rest of the methods included herein may be executed by a controller (e.g., the electronic controller of assembly robot 791 shown schematically by FIG. 8 and described above) based on instructions stored on a memory of the controller and in conjunction with signals received from sensors of an engine assembly robot (e.g., assembly robot 791), such as the position sensor described above with reference to FIGS. 9-10. The controller may employ actuators of the robot to adjust operation of the robot (e.g., control an arm of the robot to couple the spark plug to the cylinder head), according to the methods described below.

At 1102, the method includes positioning a spark plug within a passage of a cylinder head, the spark plug including a housing section having a first groove positioned opposite from a second groove across a central axis of the spark plug. In one example, the passage may be similar to passage 756 shown by FIG. 8 and described above. The housing section, first groove, second groove, and central axis may be similar to the housing section 212, first groove 216, second groove 300, and central axis 206 described above (with reference to FIGS. 2-3, for example). Positioning the spark plug within the passage may include inserting the spark plug into the passage via an opening of the passage positioned at an exterior surface of the cylinder head (e.g., similar to opening 757 at exterior surface 765 shown by FIG. 8 and described above). For example, the assembly robot may insert the spark plug into the passage via an arm of the assembly robot (e.g. arm 798 shown by FIG. 8 and described above).

The method at 1102 optionally includes step 1104, where the method includes engaging the spark plug with a shoulder of the passage. For example, one or more portions of the spark plug (e.g., portions similar to the radial extension 218 described above with reference to FIGS. 2-3) may be positioned in engagement with the shoulder of the passage. In one example, the shoulder may be similar to shoulder 763 shown by FIG. 8 and/or shoulder 151 shown by FIG. 1 and described above.

The method continues from 1102 to 1106 where the method includes locking the spark plug to the cylinder head. In one example, locking the spark plug to the cylinder head includes engaging threads of the spark plug with counterpart threads of the cylinder head. The threads and counterpart threads may be similar to threads 222 and counterpart threads 758 shown by FIG. 8 and described above. As one example, the assembly robot may rotate the spark plug within the cylinder head by rotating the arm of the assembly robot coupled to the spark plug in order to engage the threads of the spark plug with the counterpart threads of the cylinder head.

The method continues from 1106 to 1108 where the method includes coupling a tool including a first protrusion and a second protrusion to the spark plug by engaging the first protrusion and second protrusion with the first groove and second groove. In one example, the tool, first protrusion, and second protrusion may be similar to the tool 400, first protrusion 408, and second protrusion 410, respectively, shown by FIG. 5 and described above. The tool may couple to the spark plug (e.g., engage with the spark plug) by engaging the first protrusion and second protrusion with the first groove and second groove in either of two different configurations (e.g., similar to the examples described above). For example, in the first configuration, the first protrusion engages with the first groove and the second protrusion engages with the second groove. In the second configuration, the first protrusion engages with the second groove and the second protrusion engages with the first groove. In one example, the tool may be coupled to the arm of the assembly robot, and the electronic controller of the assembly robot may actuate the arm in order to position the arm such that the tool couples with the spark plug.

The method continues from 1108 to 1110 where the method includes determining an angular position of the tool relative to the cylinder head. As described above with reference to tool 400, the angular position of the tool corresponds to an orientation of the tool relative to the cylinder head (e.g., an amount of rotation of the tool relative to the cylinder head). For example, as described above, during conditions in which the tool is coupled to the spark plug, a central axis of the tool may be aligned with a central axis of the passage. The angular position of the tool may correspond to an amount of angle of the first protrusion and/or second protrusion from an axis extending radially from the central axis of the tool, the spark plug, and the passage (e.g., axis 852 shown by FIGS. 9-10 and described above). In one example, the angular position of the tool relative to the cylinder head may be determined by one or more position sensors of the assembly robot (e.g., as described above with reference to FIGS. 9-10). For example, the one or more position sensors may transmit signals (e.g., electrical signals) to an electronic controller of the assembly robot in order to indicate the detected angular position of the tool. The tool may be coupled to an arm of the assembly robot in an initial position in which the position of the first protrusion and/or second protrusion is known relative to the arm, and the controller may monitor the amount of rotation of the arm in order to track (e.g., monitor) the amount of rotation of the tool.

The method continues from 1110 to 1112 where the method includes determining an angular position of the spark plug based on the angular position of the tool. The angular position of the spark plug corresponds to a position (e.g., an amount of angle) of the base of the ground electrode of the spark plug relative to the axis extending radially from the central axis of the spark plug (e.g., axis 852). In one example, the assembly robot may estimate and/or infer the angular position of the spark plug based on an amount of rotation of the tool from the initial position of the tool. For example, during conditions in which the tool is coupled to the spark plug, the assembly robot may turn the tool in order to turn the spark plug within the cylinder head (e.g., to adjust the position of the ground electrode within the combustion chamber). By monitoring (e.g., recording) the amount by which the tool is turned (e.g., rotated), the controller may determine the amount by which the spark plug is turned.

The method continues from 1112 to 1114 where the method includes adjusting the spark plug to one of only two opposing positions by rotating the tool. The two opposing positions includes a first position in which a center of the base of the ground electrode of the spark plug is intersected by the axis arranged radially relative to the central axis of the spark plug (e.g., axis 852) and a second position in which spark plug is rotated 180 degrees relative to the first position. For example, the two opposing positions may be similar to the first position shown by FIG. 9 and the second position shown by FIG. 10.

Adjusting the spark plug to one of the only two opposing positions may include driving (e.g., rotating) the spark plug by a smaller of two amounts via the assembly robot (e.g., via rotation of the arm of the assembly robot coupled with the tool). For example, prior to adjusting the spark plug to one of the only two opposing positions, the angular position of the spark plug may be 40 degrees relative to the first position and 120 degrees relative to the second position. Because the angular position of the spark plug is closer to the first position than the second position prior to adjustment of the spark plug, the method at 1114 may include adjusting the spark plug to the first position instead of the second position. Further, because the spark plug may increase engine performance in either of the first position or second position by a greater amount than each other position (e.g., by increasing an arc length of a spark produced by the spark plug and/or increasing a flow speed of intake air charge into the combustion chamber as described above), the spark plug may be adjusted (e.g., rotated) to the closer of the two positions to increase engine performance regardless of the initial position of the spark plug.

FIGS. 2-10 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, by configuring the housing section of the spark plug to include the first groove and second groove, and by configuring the tool to couple with the spark plug by engaging the protrusions of the tool with the grooves of the spark plug, the position of the ground electrode within the combustion chamber may be more easily adjusted. Specifically, during conditions in which the tool is coupled to the spark plug, because the position of the base of the ground electrode corresponds to the position of the grooves of the spark plug and because the protrusions of the tool engage with the grooves of the spark plug in only two opposing configurations, the angular position of the tool indicates whether the spark plug is in one of only two opposing positions. Engine performance may be increased during conditions in which the spark plug is in either of the only two opposing positions. The tool may be rotated by a smallest amount of angle in order to adjust the spark plug to the closer of the only two opposing positions from an initial position of the spark plug.

The technical effect of adjusting the spark plug to either of the only two opposing positions is to adjust the position the base of the ground electrode of the spark plug within the combustion chamber to increase engine performance.

In one embodiment, a spark plug comprises: a housing section having a plurality of planar surfaces arranged annularly around a central axis of the spark plug, including a first planar surface arranged opposite a second planar surface, and coupled to a threaded section of the spark plug; and only two grooves in the housing section, including a first groove in the first planar surface and a second groove in the second planar surface. In a first example of the spark plug, the second groove is radially aligned with a base of a ground electrode of the spark plug relative to the central axis. A second example of the spark plug optionally includes the first example, and further includes wherein a first axis arranged parallel to a second axis extending radially from the central axis and intersecting a center of the base of the ground electrode intersects each of a center of the first groove and a center of the second groove. A third example of the spark plug optionally includes one or both of the first and second examples, and further includes wherein the center of the second groove is offset from the center of first groove by 180 degrees around the central axis. A fourth example of the spark plug optionally includes one or more or each of the first through third examples, and further includes wherein the housing section is arranged between a terminal of the spark plug and a radial protrusion of the spark plug, the radial protrusion arranged between the housing section and a ground electrode of the spark plug in a direction of the central axis, with the threaded section positioned between the radial protrusion and the ground electrode.

In one embodiment, a method comprises: driving an assembly robot to couple a spark plug to a cylinder head of an engine; and driving the assembly robot to adjust a position of the spark plug within the cylinder head to one of two positions via a tool coupled to the assembly robot, the tool including first and second mating features shaped to engage with first and second counterpart mating features of a housing section of the spark plug. In a first example of the method, coupling the spark plug to the cylinder head includes positioning the spark plug in an initial position by engaging threads of the spark plug with counterpart threads of the cylinder head, and adjusting the position of the spark plug within the cylinder head to one of the two positions via the tool includes adjusting the spark plug from the initial position to one of only the two positions. A second example of the method optionally includes the first example, and further includes wherein the two positions includes a first position in which a first axis intersecting a center of a base of a ground electrode of the spark plug and a central axis of the spark plug is parallel to a second axis intersecting centers of two exhaust valves or two intake valves coupled to the cylinder head, and a second position in which the center of the base of the ground electrode is offset from the first position by 180 degrees around the central axis of the spark plug. A third example of the method optionally includes one or both of the first and second examples, and further includes wherein adjusting the spark plug to one of the two positions includes adjusting the spark plug via the tool from the initial position to a closer position of the two positions. A fourth example of the method optionally includes one or more or each of the first through third examples, and further includes wherein adjusting the spark plug to the closer position of the two positions includes rotating the spark plug via the tool in a first direction until the first axis is parallel with the second axis, with an amount of rotation of the spark plug in the first direction to position the first axis parallel with the second axis being smaller than an amount of rotation of the spark plug in a second, opposing position to position the first axis parallel with the second axis. A fifth example of the method optionally includes one or more or each of the first through fourth examples, and further includes wherein adjusting the position of the spark plug within the cylinder head to one of the two positions via the tool includes engaging the tool with the spark plug in a first configuration in which the first mating feature is seated within the first counterpart mating feature and the second mating feature is seated within the second counterpart mating feature, or a second configuration in which the first mating feature is seated within the second counterpart mating feature and the second mating feature is seated within the first counterpart mating feature, and rotating the spark plug by rotating the tool in the first or second configuration. A sixth example of the method optionally includes one or more or each of the first through fifth examples, and further includes wherein adjusting the position of the spark plug within the cylinder head to one of the two positions includes determining an angular position of the tool relative to the cylinder head while the tool is coupled to the spark plug. A seventh example of the method optionally includes one or more or each of the first through sixth examples, and further includes determining an initial position of the spark plug within the cylinder head based on the angular position of the tool while the tool is coupled to the spark plug in the first or second configuration. An eighth example of the method optionally includes one or more or each of the first through seventh examples, and further includes wherein adjusting the position of the spark plug within the cylinder head to one of the two positions further comprises rotating the tool to drive the spark plug from the initial position to a closer of the two positions, where the direction of rotation is in a direction from the initial position to the closer of the two positions.

In one embodiment, a system comprises: a spark plug, comprising: a ground electrode positioned at a first end of the spark plug, adjacent to a threaded section of the spark plug; a housing section positioned between the threaded section of the spark plug and a second end of the spark plug opposite the first end, the housing section including a first planar surface including a first mating feature and an opposite, second planar surface including a second mating feature; and a radial extension coupled between the housing section and the threaded section, the radial extension extending radially outward from each of the threaded section and housing section relative to a central axis of the spark plug; and a cylinder head, comprising: a passage including counterpart threads adapted to receive the threaded section and a shoulder arranged adjacent to the counterpart threads, the counterpart threads arranged at a combustion chamber and the shoulder adapted to receive the radial extension. In a first example of the system, the first mating feature is a first groove and the second mating feature is a second groove, with the first groove centered in the first planar surface and the second groove centered in the second planar surface, and with the first and second groove each extending toward a central axis of the spark plug. A second example of the system optionally includes the first example, and further includes wherein a base of the ground electrode is radially aligned with either of the first groove or second groove, with the ground electrode extending from the base toward the central axis. A third example of the system optionally includes one or both of the first and second examples, and further includes wherein the first mating feature is a first protrusion and the second mating feature is a second protrusion, the first protrusion centered at the first planar surface and the second protrusion centered at the second planar surface, the first and second protrusion each extending away from a central axis of the spark plug. A fourth example of the system optionally includes one or more or each of the first through third examples, and further includes wherein the first planar surface is arranged parallel with the second planar surface, the first and second planar surface each positioned a same length from a central axis of the spark plug. A fifth example of the system optionally includes one or more or each of the first through fourth examples, and further includes wherein the shoulder and counterpart threads do not include slots or protrusions shaped to receive the first and second mating features.

In another embodiment, a system comprises: a spark plug, comprising: a ground electrode positioned at a first end of the spark plug, adjacent to a threaded section of the spark plug; a housing section positioned between the threaded section of the spark plug and a second end of the spark plug opposite the first end, the housing section including a first planar surface including a first mating feature and an opposite, second planar surface including a second mating feature; and a radial extension coupled between the housing section and the threaded section, the radial extension extending radially outward from each of the threaded section and housing section relative to a central axis of the spark plug; a cylinder head, comprising: a passage including counterpart threads adapted to receive the threaded section and a shoulder arranged adjacent to the counterpart threads, the counterpart threads arranged at a combustion chamber and the shoulder adapted to receive the radial extension; and an assembly robot with computer readable instructions stored on non-transitory memory that when executed, cause the assembly robot to: couple a spark plug to a cylinder head of an engine; and adjust a position of the spark plug within the cylinder head to one of only two positions via a tool coupled to the assembly robot, the tool including first and second mating features shaped to engage with first and second counterpart mating features of a housing section of the spark plug.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

driving an assembly robot to couple a spark plug to a cylinder head of an engine; and driving the assembly robot to adjust a position of the spark plug within the cylinder head to one of two positions via a tool coupled to the assembly robot, the tool including first and second mating features shaped to engage with first and second counterpart mating features of a housing section of the spark plug, wherein the two positions includes a first position in which a first axis intersecting a center of a base of a ground electrode of the spark plug and a central axis of the spark plug is parallel to a second axis intersecting centers of two exhaust valves or two intake valves coupled to the cylinder head, and a second position in which the center of the base of the ground electrode is offset from the first position by 180 degrees around the central axis of the spark plug.

2. The method of claim 1, wherein coupling the spark plug to the cylinder head includes positioning the spark plug in an initial position by engaging threads of the spark plug with counterpart threads of the cylinder head, and wherein adjusting the position of the spark plug within the cylinder head to one of the two positions via the tool includes adjusting the spark plug from the initial position to one of only the two positions.

3. The method of claim 2, wherein adjusting the spark plug to one of the two positions includes adjusting the spark plug via the tool from the initial position to a closer position of the two positions.

4. The method of claim 3, wherein adjusting the spark plug to the closer position of the two positions includes rotating the spark plug via the tool in a first direction until the first axis is parallel with the second axis, with an amount of rotation of the spark plug in the first direction to position the first axis parallel with the second axis being smaller than an amount of rotation of the spark plug in a second, opposing position to position the first axis parallel with the second axis.

5. The method of claim 1, wherein adjusting the position of the spark plug within the cylinder head to one of the two positions via the tool includes engaging the tool with the spark plug in a first configuration in which the first mating feature is seated within the first counterpart mating feature and the second mating feature is seated within the second counterpart mating feature, or a second configuration in which the first mating feature is seated within the second counterpart mating feature and the second mating feature is seated within the first counterpart mating feature, and rotating the spark plug by rotating the tool in the first or second configuration.

6. The method of claim 5, A method, comprising:

driving an assembly robot to couple a spark plug to a cylinder head of an engine; and driving the assembly robot to adjust a position of the spark plug within the cylinder head to one of two positions via a tool coupled to the assembly robot, the tool including first and second mating features shaped to engage with first and second counterpart mating features of a housing section of the spark plug, wherein adjusting the position of the spark plug within the cylinder head to one of the two positions includes determining an angular position of the tool relative to the cylinder head while the tool is coupled to the spark plug.

7. The method of claim 6, further comprising determining an initial position of the spark plug within the cylinder head based on the angular position of the tool while the tool is coupled to the spark plug in the first or second configuration.

8. The method of claim 7, wherein adjusting the position of the spark plug within the cylinder head to one of the two positions further comprises rotating the tool to drive the spark plug from the initial position to a closer of the two positions, where the direction of rotation is in a direction from the initial position to the closer of the two positions.

9. A method, comprising:

driving an assembly robot to couple a spark plug to a cylinder head of an engine; and driving the assembly robot to adjust a position of the spark plug within the cylinder head to one of only two positions via a tool coupled to the assembly robot, the tool including first and second mating features shaped to engage with first and second counterpart mating features of a housing section of the spark plug, the spark plug housing having only two grooves with the only two positions have one of the grooves aligned with a feature of the cylinder head, the second groove radially aligned with a base of a ground electrode of the spark plug, and the first groove radially opposite to the second groove.

10. The method of claim 9, wherein the first and second grooves are shaped to engage with first and second mating feature of the tool.

* * * * *